US007013104B2

(12) United States Patent
MacMillan et al.

(10) Patent No.: US 7,013,104 B2
(45) Date of Patent: Mar. 14, 2006

(54) TONER REGULATING SYSTEM HAVING TONER REGULATING MEMBER WITH METALLIC COATING ON FLEXIBLE SUBSTRATE

(75) Inventors: David Starling MacMillan, Winchester, KY (US); Vernon Wayne Ulrich, Versailles, KY (US); Jarrett C. Gayne, Lexington, KY (US); Johnny Dale Massie, II, Lexington, KY (US); Scott Richard Castle, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 158 days.

(21) Appl. No.: 10/799,954

(22) Filed: Mar. 12, 2004

(65) Prior Publication Data

US 2005/0201781 A1 Sep. 15, 2005

(51) Int. Cl.
*G03G 15/08* (2006.01)

(52) U.S. Cl. ..... 399/284; 399/274

(58) Field of Classification Search ..... 399/284, 399/274, 286

See application file for complete search history.

(56) References Cited

U.S. PATENT DOCUMENTS

| | | | |
|---|---|---|---|
| 3,418,972 | A | 12/1968 | Obuchi |
| 3,667,428 | A | 6/1972 | Smith |
| 3,696,785 | A | 10/1972 | Andrus |
| 3,697,169 | A | 10/1972 | Maksymiak |
| 3,830,199 | A | 8/1974 | Saito |
| 3,875,581 | A | 4/1975 | Yamashita |
| 3,942,474 | A | 3/1976 | Smith |
| 3,986,453 | A | 10/1976 | Boose |
| 4,011,834 | A | 3/1977 | Stephan |
| 4,020,788 | A | 5/1977 | Brooke |
| 4,026,648 | A | 5/1977 | Takahashi |
| 4,057,340 | A | 11/1977 | Bean |
| 4,119,060 | A | 10/1978 | Mochizuki |
| 4,194,830 | A | 3/1980 | Ohnuma |
| 4,218,691 | A | 8/1980 | Fujii |
| 4,232,628 | A | 11/1980 | Shelffo |
| 4,281,622 | A | 8/1981 | Kudo |
| 4,286,543 | A | 9/1981 | Ohnuma |
| 4,297,384 | A | 10/1981 | Kudo |
| 4,378,158 | A | 3/1983 | Kanbe |
| 4,382,420 | A | 5/1983 | Ohnuma |
| 4,395,110 | A | 7/1983 | Hosono |
| 4,406,535 | A | 9/1983 | Sakamoto |
| 4,454,833 | A | 6/1984 | McChesney |
| 4,458,627 | A | 7/1984 | Hosono |
| 4,459,009 | A | 7/1984 | Hays |
| 4,498,756 | A | 2/1985 | Hosoya |
| 4,502,412 | A | 3/1985 | Jones |

(Continued)

*Primary Examiner*—Louis Arana
(74) *Attorney, Agent, or Firm*—Coats & Bennett, PLLC

(57) ABSTRACT

A toner layer regulating system for an electrophotographic image forming apparatus includes a toner carrier; a toner regulating member (e.g., doctor blade) disposed proximate the toner carrier, with the toner regulating member having a first surface disposed toward the toner carrier and forming a nip with the toner carrier. The toner regulating member comprise a flexible metallic substrate and a metallic coating on the first surface in an area thereof forming the nip. The coating on the toner regulating member comprises a material selected from the group consisting of molybdenum, tungsten carbide, and alloys thereof. The coating may be substantially homogeneous and/or have a thickness of not more than 30 um. The coating may have a relatively smooth surface roughness of ≦2.0 um Ra.

49 Claims, 5 Drawing Sheets

U.S. PATENT DOCUMENTS

| | | | |
|---|---|---|---|
| 4,505,573 | A | 3/1985 | Brewington |
| 4,528,436 | A | 7/1985 | Stol |
| 4,528,936 | A | 7/1985 | Shimazaki |
| 4,538,898 | A | 9/1985 | Kanno |
| 4,544,935 | A | 10/1985 | Sakai |
| 4,553,149 | A | 11/1985 | Yano |
| 4,566,402 | A | 1/1986 | Shimazaki |
| 4,566,776 | A | 1/1986 | Kondoh |
| 4,575,220 | A | 3/1986 | Sakamoto |
| 4,579,081 | A | 4/1986 | Kohyama |
| 4,585,328 | A | 4/1986 | Moser |
| 4,615,606 | A | 10/1986 | Nishikawa |
| 4,616,918 | A | 10/1986 | Kohyama |
| 4,624,545 | A | 11/1986 | Yasuda |
| 4,625,676 | A | 12/1986 | Sakamoto |
| 4,656,965 | A | 4/1987 | Hosoya |
| 4,669,852 | A | 6/1987 | Tajima |
| 4,674,439 | A | 6/1987 | Sakamoto |
| 4,686,934 | A | 8/1987 | Kohyama |
| 4,695,153 | A | 9/1987 | Matsushita |
| 4,707,115 | A | 11/1987 | Bares |
| 4,748,472 | A | 5/1988 | Mukai |
| 4,755,847 | A | 7/1988 | Matsushiro |
| 4,760,422 | A | 7/1988 | Seimiya |
| 4,766,468 | A | 8/1988 | Hosono |
| 4,777,904 | A | 10/1988 | Gundlach |
| 4,780,741 | A | 10/1988 | Wada |
| 4,780,743 | A | 10/1988 | Asada |
| 4,788,570 | A | 11/1988 | Ogata |
| 4,792,831 | A | 12/1988 | Takeda |
| 4,806,992 | A | 2/1989 | Yasuda |
| 4,811,686 | A | 3/1989 | Yamane |
| 4,833,058 | A | 5/1989 | Hirano |
| 4,836,135 | A | 6/1989 | Kohyama |
| 4,839,688 | A | 6/1989 | Bares |
| 4,841,331 | A | 6/1989 | Nakayama |
| 4,847,653 | A | 7/1989 | Doi |
| 4,857,954 | A | 8/1989 | Abuyama |
| 4,866,480 | A | 9/1989 | Hosoya |
| 4,876,575 | A | 10/1989 | Hays |
| 4,893,151 | A | 1/1990 | Yamazaki |
| 4,908,291 | A | 3/1990 | Fuma |
| 4,916,492 | A | 4/1990 | Hoshika |
| 4,920,916 | A | 5/1990 | Mizuno |
| 4,947,200 | A | 8/1990 | Kumasaka |
| 4,990,959 | A | 2/1991 | Yamamuro |
| 5,006,898 | A | 4/1991 | Kobayashi |
| 5,010,815 | A | 4/1991 | Weisbrod |
| 5,054,419 | A | 10/1991 | Itaya |
| 5,057,871 | A | 10/1991 | Hirose |
| 5,062,385 | A | 11/1991 | Nishio |
| 5,068,691 | A | 11/1991 | Nishio |
| 5,075,728 | A | 12/1991 | Kobayashi |
| 5,076,201 | A | 12/1991 | Nishio |
| 5,085,171 | A | 2/1992 | Aulick |
| 5,086,728 | A | 2/1992 | Kinoshita |
| 5,095,341 | A | 3/1992 | Yoshida |
| 5,097,294 | A | 3/1992 | Nishio |
| 5,134,960 | A | 8/1992 | Shirai |
| 5,140,373 | A | 8/1992 | Ikegawa |
| 5,142,330 | A | 8/1992 | Hirano |
| 5,155,532 | A | 10/1992 | Sakurada |
| 5,164,773 | A | 11/1992 | Nishio |
| 5,164,774 | A | 11/1992 | Tomita |
| 5,168,312 | A | 12/1992 | Aoto |
| 5,170,213 | A | 12/1992 | Yamaguchi |
| 5,177,323 | A | 1/1993 | Kohyama |
| 5,178,065 | A | 1/1993 | Reder |
| 5,185,632 | A | 2/1993 | Yoshida |
| 5,191,170 | A | 3/1993 | Yoshida |
| 5,202,728 | A | 4/1993 | Maeshima |
| 5,210,575 | A | 5/1993 | Kikuchi |
| 5,214,478 | A | 5/1993 | Honma |
| 5,220,129 | A | 6/1993 | Nishio |
| 5,232,500 | A | 8/1993 | Kamaji |
| 5,233,390 | A | 8/1993 | Fujimoto |
| 5,235,387 | A | 8/1993 | Sato |
| 5,237,375 | A | 8/1993 | Michlin |
| 5,257,075 | A | 10/1993 | Ohki |
| 5,260,748 | A | 11/1993 | Kahle |
| 5,278,616 | A | 1/1994 | Hirano |
| 5,287,150 | A | 2/1994 | Kinoshita |
| 5,289,237 | A | 2/1994 | Hashizume |
| 5,303,010 | A | 4/1994 | Takano |
| 5,311,264 | A | 5/1994 | Kinoshita |
| 5,324,884 | A | 6/1994 | Honda |
| 5,338,895 | A | 8/1994 | Ikegawa |
| 5,353,104 | A | 10/1994 | Kato |
| 5,369,478 | A | 11/1994 | Kobayashi |
| 5,373,353 | A | 12/1994 | Fukasawa |
| 5,387,967 | A | 2/1995 | Brewington |
| 5,389,732 | A | 2/1995 | Sekino |
| 5,404,211 | A | 4/1995 | Hashimoto |
| 5,412,458 | A | 5/1995 | Kamaji |
| 5,438,395 | A | 8/1995 | Koga |
| 5,481,343 | A | 1/1996 | Bhagat |
| 5,485,254 | A | 1/1996 | Bogoshian |
| 5,489,974 | A | 2/1996 | Kamaji |
| 5,493,370 | A | 2/1996 | Brewington |
| 5,499,086 | A | 3/1996 | Matsuno |
| 5,519,471 | A | 5/1996 | Nishimura |
| 5,519,472 | A | 5/1996 | Ojima |
| 5,548,382 | A | 8/1996 | Koshi |
| 5,552,867 | A | 9/1996 | Sekino |
| 5,557,060 | A | 9/1996 | Okada |
| 5,570,166 | A | 10/1996 | Ohzeki |
| 5,570,168 | A | 10/1996 | Koga |
| 5,585,895 | A | 12/1996 | Yashiro |
| 5,587,551 | A | 12/1996 | Ikegawa |
| 5,587,776 | A | 12/1996 | Watabe |
| 5,602,631 | A | 2/1997 | Sakaguchi |
| 5,609,921 | A | 3/1997 | Gitzhofer |
| 5,623,718 | A | 4/1997 | Bracken |
| 5,628,043 | A | 5/1997 | Ikeda |
| 5,649,197 | A | 7/1997 | Fujita |
| 5,682,585 | A | 10/1997 | Yamaguchi |
| 5,689,783 | A | 11/1997 | Sasame |
| 5,708,941 | A | 1/1998 | Koga |
| 5,708,942 | A | 1/1998 | Sugiyama |
| 5,708,943 | A | 1/1998 | Applegate |
| 5,722,021 | A | 2/1998 | Iwao |
| 5,722,022 | A | 2/1998 | Park |
| 5,729,806 | A | 3/1998 | Niwano |
| 5,737,670 | A | 4/1998 | Ikegawa |
| 5,737,676 | A | 4/1998 | Maeda |
| 5,752,146 | A | 5/1998 | Sato |
| 5,761,590 | A | 6/1998 | Sato |
| 5,768,670 | A | 6/1998 | Enomoto |
| 5,797,075 | A | 8/1998 | Saito |
| 5,797,076 | A | 8/1998 | Bracken |
| 5,805,965 | A | 9/1998 | Tsuda |
| 5,805,966 | A | 9/1998 | Yamada |
| 5,812,911 | A | 9/1998 | Asanae |
| 5,812,918 | A | 9/1998 | Nakaue |
| 5,819,145 | A | 10/1998 | Tanaka |
| 5,853,868 | A | 12/1998 | Bracken |
| 5,857,134 | A | 1/1999 | Ahn |
| 5,862,444 | A | 1/1999 | Machida |
| 5,863,329 | A | 1/1999 | Yamanouchi |
| 5,867,756 | A | 2/1999 | Suzuki |
| 5,867,758 | A | 2/1999 | Yoshida |
| 5,870,658 | A | 2/1999 | Goto |
| 5,875,379 | A | 2/1999 | Machida |
| 5,875,382 | A | 2/1999 | Inoue |

5,893,013 A 4/1999 Kinoshita
5,895,150 A 4/1999 Watabe
5,895,151 A 4/1999 Kinoshita
5,897,246 A 4/1999 Yamashita
5,907,757 A 5/1999 Suzuki
5,920,754 A 7/1999 Chung
5,933,692 A 8/1999 Niwano
5,937,253 A 8/1999 Shimazaki
5,960,239 A 9/1999 Toyoshima
5,978,636 A 11/1999 Yamamoto
6,006,060 A 12/1999 Sato
6,021,297 A 2/2000 Campbell
6,021,298 A 2/2000 Liu
6,021,299 A 2/2000 Hansburg
6,038,416 A 3/2000 Okano
6,049,345 A 4/2000 Nishio
6,049,689 A 4/2000 Ishii
6,053,102 A 4/2000 Schonberger
6,058,284 A 5/2000 Okano
6,064,463 A 5/2000 Yamada
6,078,770 A 6/2000 Watabe
6,094,555 A 7/2000 Katoh
6,134,403 A 10/2000 Haneda
6,144,829 A 11/2000 Miyasaka
6,148,167 A 11/2000 Komakine
6,163,674 A 12/2000 Ichikawa
6,175,710 B1 1/2001 Kamaji
6,195,522 B1 2/2001 Sato
6,223,014 B1 4/2001 Niwano
6,253,052 B1 6/2001 Cornelius
6,256,471 B1 7/2001 Sato
6,258,918 B1 7/2001 Ho
6,263,180 B1 7/2001 VanLaeken
6,278,849 B1 8/2001 Kawasaki
6,282,395 B1 8/2001 Nittani
6,298,203 B1 10/2001 Hashimoto
6,301,461 B1 10/2001 Sirejacob
6,308,038 B1 10/2001 Kakeshita
6,321,058 B1 11/2001 Miyasaka
6,330,416 B1 12/2001 Yamada
6,339,686 B1 1/2002 Yamanaka
6,341,206 B1 1/2002 Yamaguchi
6,356,730 B1 3/2002 Nonaka
6,360,068 B1 * 3/2002 Kinoshita et al. ..... 399/284
6,360,069 B1 3/2002 Mimura
6,389,258 B1 5/2002 Tano
6,405,015 B1 6/2002 Suzuki
6,423,427 B1 7/2002 Mehmood
6,431,066 B1 8/2002 Perez
6,438,346 B1 8/2002 Kamimura
6,456,813 B1 9/2002 Sato
6,459,867 B1 10/2002 Ohgoshi
6,463,245 B1 10/2002 Suwa
6,463,246 B1 10/2002 Mizuno
6,466,760 B1 10/2002 Mizuno
6,484,006 B1 11/2002 Izumi
6,487,383 B1 11/2002 Buchanan
6,528,158 B1 3/2003 Kuroda
6,560,430 B1 5/2003 Muto
6,603,944 B1 8/2003 Tatsumi
6,606,474 B1 8/2003 Sirejacob
6,633,739 B1 * 10/2003 White et al. ..... 399/353
2001/0026715 A1 10/2001 Tatsumi
2001/0048828 A1 12/2001 Ishii
2002/0012553 A1 1/2002 Endoh
2002/0191990 A1 12/2002 Hirano
2002/0197086 A1 12/2002 Ishibashi
2003/0194250 A1 10/2003 Ishigaki

* cited by examiner

TONER REGULATING SYSTEM HAVING TONER REGULATING MEMBER WITH METALLIC COATING ON FLEXIBLE SUBSTRATE

FIELD OF THE INVENTION

The present invention is directed generally the field of electrophotographic printing, and more particularly to a toner regulating member with a metallic coating on a flexible substrate.

BACKGROUND OF THE INVENTION

One step in the electrophotographic printing process typically involves providing a relatively uniform layer of toner on a toner carrier, such as a developer roller, that in turn supplies that toner to photoconductive element to develop a latent image thereon. Typically, it is advantageous if the toner layer has a uniform thickness and a uniform charge level. As is known in the art, one typical approach to regulating the toner on the toner carrier is to employ a doctor (or metering) blade. While there have been a number of doctor blade designs proposed in the art, there remains a need for alternative designs that address the special concerns of the electrophotographic development process.

SUMMARY OF THE INVENTION

The present invention, in one embodiment, provides a toner layer regulating system for an electrophotographic image forming apparatus. The toner regulating system may include a toner carrier; a toner regulating member (e.g., doctor blade) disposed proximate the toner carrier, with the toner regulating member having a first surface disposed toward the toner carrier and forming a nip with the toner carrier. The toner regulating member comprises a flexible metallic substrate and a metallic coating disposed to cover an area of the first surface forming the nip. The coating on the toner regulating member may advantageously comprise at least a material selected from the group consisting of molybdenum and tungsten; indeed, such a material may be the largest constituent component of the coating. The coating may advantageously be substantially homogeneous and/or uniform in composition, have a thickness of not more than 30 um, and/or be a thermally sprayed coating of a thickness of not more than 30 um. The toner regulating member may have a first portion mounted to a support and a second portion supported in cantilever fashion by the first portion, with the nip disposed in the second portion. The coating may be limited to the second portion of the toner regulating member. The substrate may be a first material and the coating a second material different from the first material. The substrate may have a thickness in the range of 0.02 mm to 2.0 mm. The coating may advantageously have a surface roughness of $\leqq$2.0 um Ra, more advantageously 0.2 um to 1.5 um Ra, and still more advantageously a surface roughness of 0.7 um to 1.1 um Ra.

In other embodiments, the toner regulating system generally described above may be incorporated into a toner cartridge and/or an image forming device.

DETAILED DESCRIPTION OF THE INVENTION

As the present invention relates to the regulation of toner in an electrophotographic image forming apparatus, an understanding of the basic elements of an electrophotographic image forming apparatus may aid in understanding the present invention. For purposes of illustration, a four cartridge color laser printer will be described; however one skilled in the art will understand that the present invention is applicable to other types of electrophotographic image forming apparatuses that use one or more toner colors for printing. Further, for simplicity, the discussion below may use the terms "sheet" and/or "paper" to refer to the recording media 5; this term is not limited to paper sheets, and any form of recording media is intended to be encompassed therein, including without limitation, envelopes, transparencies, postcards, and the like.

Figure 1:
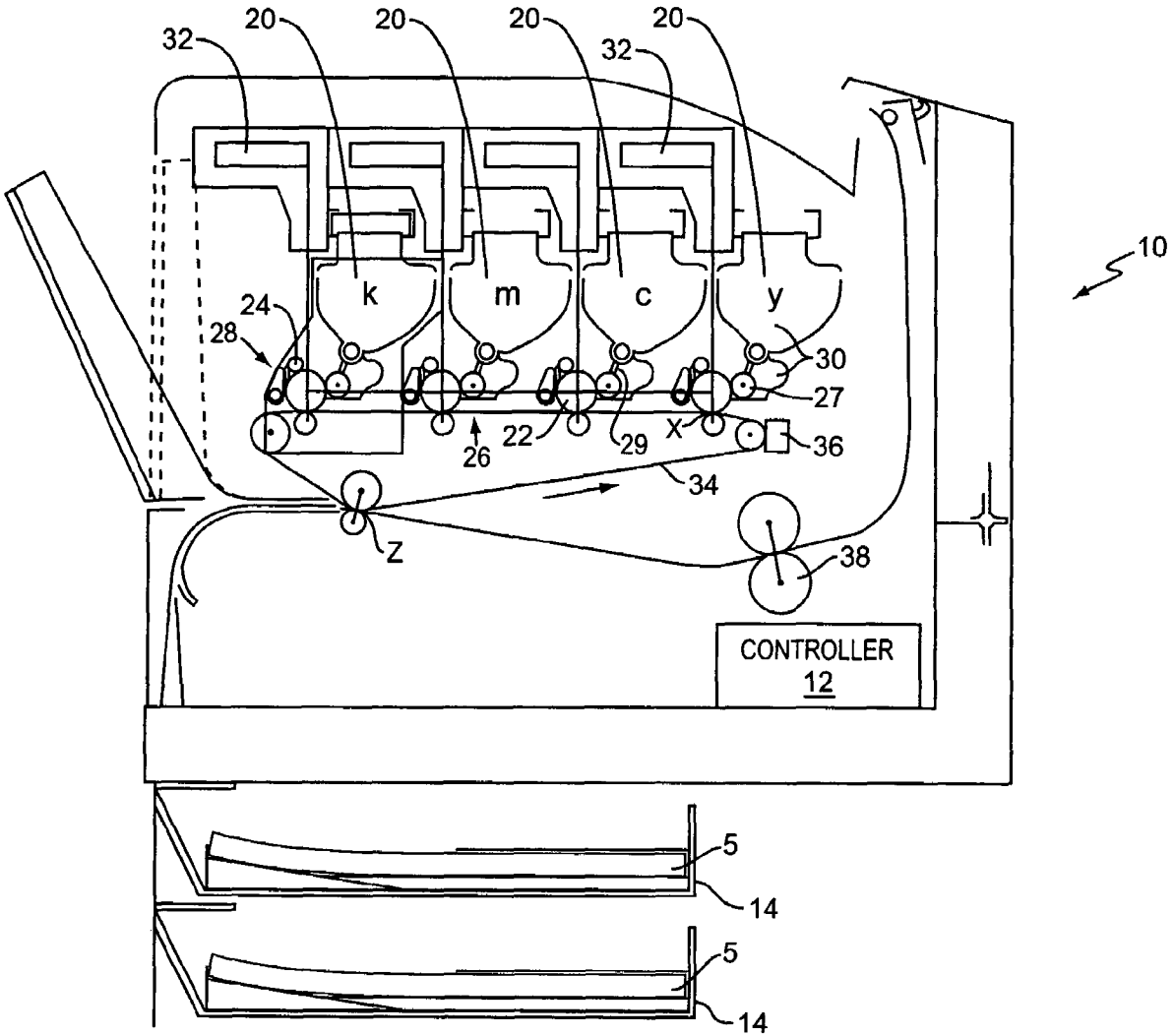
FIG. 1 shows a representation of an image forming apparatus.

A four color laser printer, generally designated 10 in FIG. 1, typically includes a plurality of optionally removable toner cartridges 20 that have different toner color contained therein, an intermediate transfer medium 34, a fuser 38, and one or more recording media supply trays 14. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22 (or "photo-conductive drum" or simply "PC drum"), a charger 24, a developer section 26, a cleaning assembly 28, and a toner supply bin 30. The photoconductor 22 is generally cylindrically-shaped with a smooth surface for receiving an electrostatic charge over the surface as the photoconductor 22 rotates past charger 24. The photoconductor 22 rotates past a scanning laser 32 directed onto a selective portion of the photoconductor surface forming an electrostatically latent image representative of the image to be printed. Drive gears (not shown) may rotate the photoconductor 22 continuously so as to advance the photoconductor 22 some uniform amount, such as 1/120th or 1/1200th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 32. To prevent toner escape around the ends of the developer roller 27, end seals may be employed, such as those described in U.S. Pat. No. 6,487,383, entitled "Dynamic End-Seal for Toner Development Unit," which is incorporated herein by reference.

The photoconductor 22 next rotates past an adjacently-positioned intermediate transfer medium ("ITM"), such as belt 34, to which the toner is transferred from the photoconductor 22. The location of this transfer from the photoconductor 22 to the ITM belt 34 is called the first transfer point (denoted X in FIG. 1). After depositing the toner on the ITM belt 34, the photoconductor 22 rotates through the cleaning section 28 where residual toner is removed from the surface of the photoconductor 22, such as via a cleaning blade well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 32.

As illustrated in FIG. 1, the ITM belt 34 is endless and extends around a series of rollers adjacent to the photoconductors 22 of the various cartridges 20. The ITM belt 34 and each photoconductor 22 are synchronized by controller 12, via gears and the like well known in the art, so as to allow the toner from each cartridge 20 to precisely align on the ITM belt 34 during a single pass. By way of example as viewed in FIG. 1, the yellow toner will be placed on the ITM belt 34, followed by cyan, magenta, and black. The purpose of the ITM belt 34 is to gather the image from the cartridges 20 and transport it to the sheet 5 to be printed on.

The paper 5 may be stored in paper supply tray 14 and supplied, via a suitable series of rollers, belts, and the like, to the location where the sheet 5 contacts the ITM belt 34. At this location, called the second transfer point (denoted Z in FIG. 1), the toner image on the ITM belt 34 is transferred to the sheet 5. If desired, the sheet 5 may receive an electrostatic charge prior to contact with the ITM belt 34 to assist in attracting the toner from the ITM belt 34. The sheet 5 and attached toner next travel through a fuser 38, typically a pair of rollers with an associated heating element, that heats and fuses the toner to the sheet 5. The paper 5 with the fused image is then transported out of the printer 10 for receipt by a user. After rotating past the second transfer point Z, the ITM belt 34 is cleaned of residual toner by an ITM cleaning assembly 36 so that the ITM belt 34 is clean again when it next approaches the first transfer point X.

Figure 2:
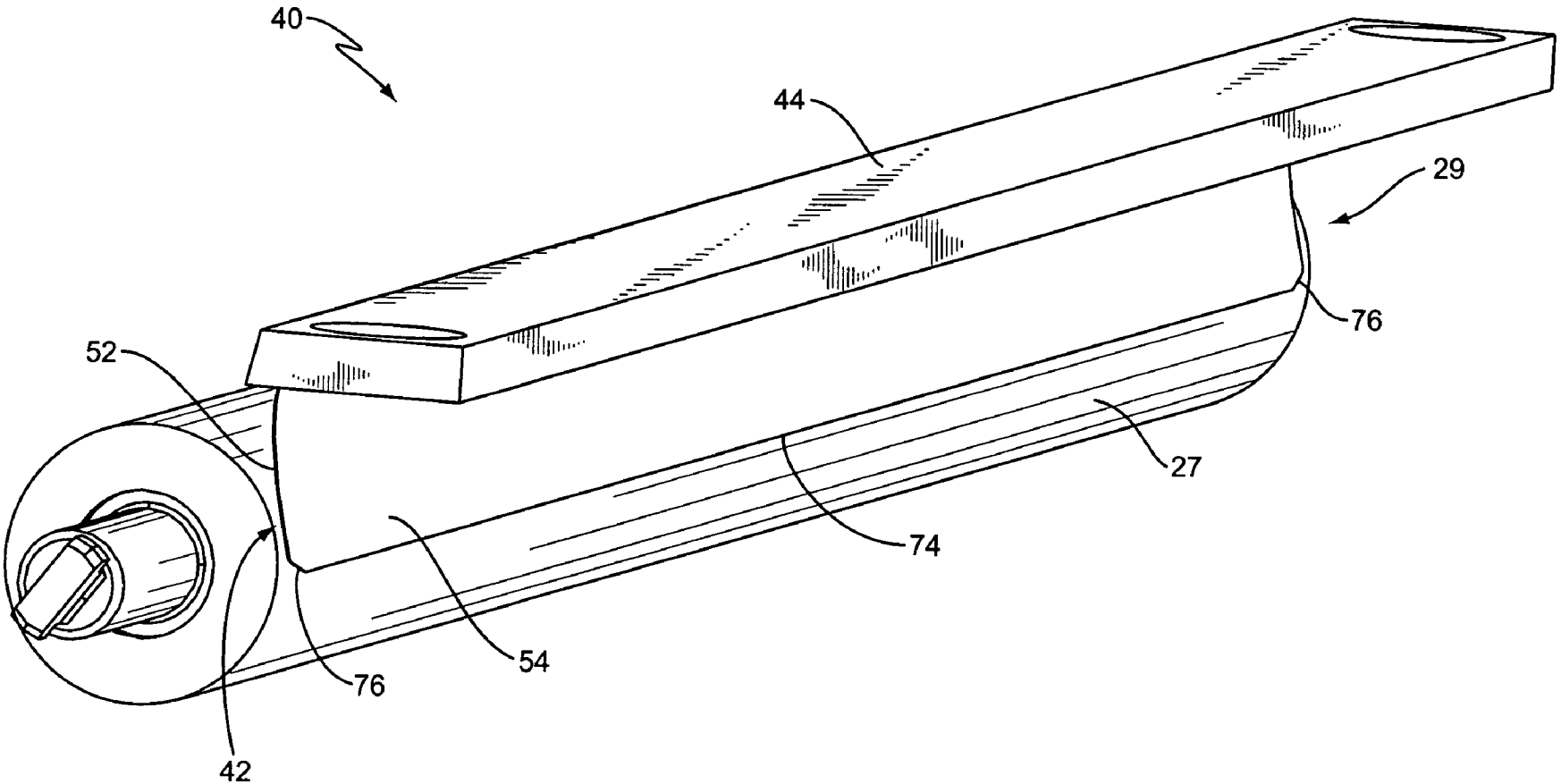
FIG. 2 shows perspective view of a doctor blade according to one embodiment of the present invention pressing against with a doctor blade.

The present invention relates to a toner regulating system 40 that may be employed in electrophotographic imaging devices, such as the printer 10 described above. The illustrative toner regulating system 40 includes the developer roller 27 and the doctor blade 29. Referring to FIG. 2, the doctor blade 29 is supported from the frame of the toner cartridge 20 on one end and presses against the developer roller 27 towards the other end. The pressing of the doctor blade 29 against the developer roller 27 with toner in-between helps regulate the toner, such as by controlling the thickness and charge level on the toner.

Figure 3:
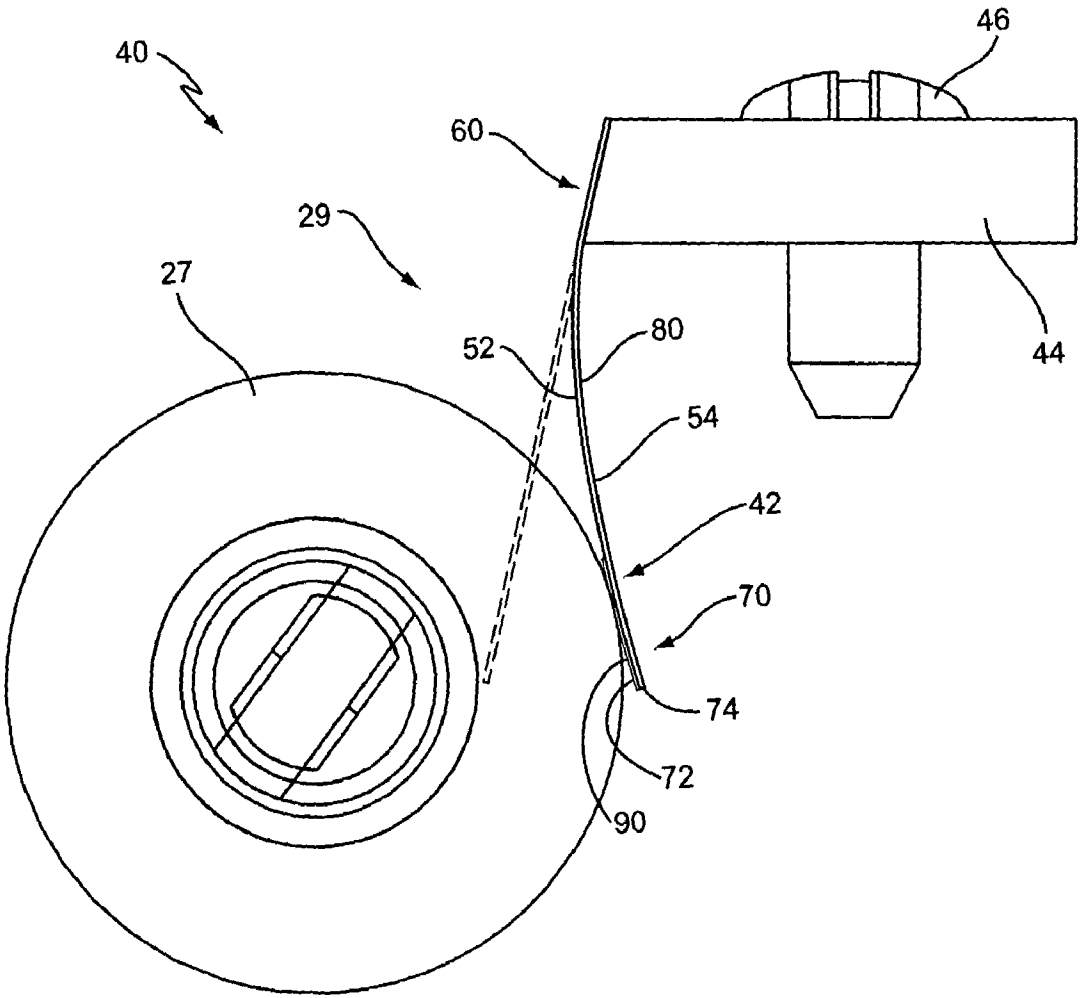
FIG. 3 shows a side view of the components of FIG. 2.

The doctor blade 29 has a generally rectangular form and may be conceptually divided into a mounting portion 60 and a nip portion 70. The mounting portion 60 of the doctor blade 29 mounts to the frame of the cartridge 20, either directly or via a suitable bracket 44. Such a bracket 44, if used, may have a simple bar-like shape and be secured to the frame of the cartridge 20 by suitable fasteners 46. Alternatively, the bracket 44 may have a curved or bowed shape, such as that shown in U.S. Pat. No. 5,489,974, or any other shape known in the art. Further, as shown in the figures, the mounting portion 60 may be advantageously mounted at an angle either toward or away from the center of the developer roller 27. For example, if a bracket 44 is used, the front face of the bracket 44 may be angled, such as a slight forward slant of 12.5° as shown in FIG. 3. The mounting portion 60 of the doctor blade 29 is advantageously mated to some structure (e.g., bracket 44) along its entire lateral length, so as to prevent toner or other debris from becoming trapped between the mounting portion 60 and its supporting structure. The mounting of the mounting portion 60 may be via any known method, such as by a plurality of spot welds, adhesives, or over-molding the support structure around the relevant end of the doctor blade 29. For the embodiment shown in the figures, the mounting portion 60 is mounted at a point downstream from the nip 42 formed between the developer roller 27 and the doctor blade 29. Thus, the doctor blade 29 is in what is commonly referred to as a "counter" (or sometimes "skiving" or "leading") orientation.

Figure 4:
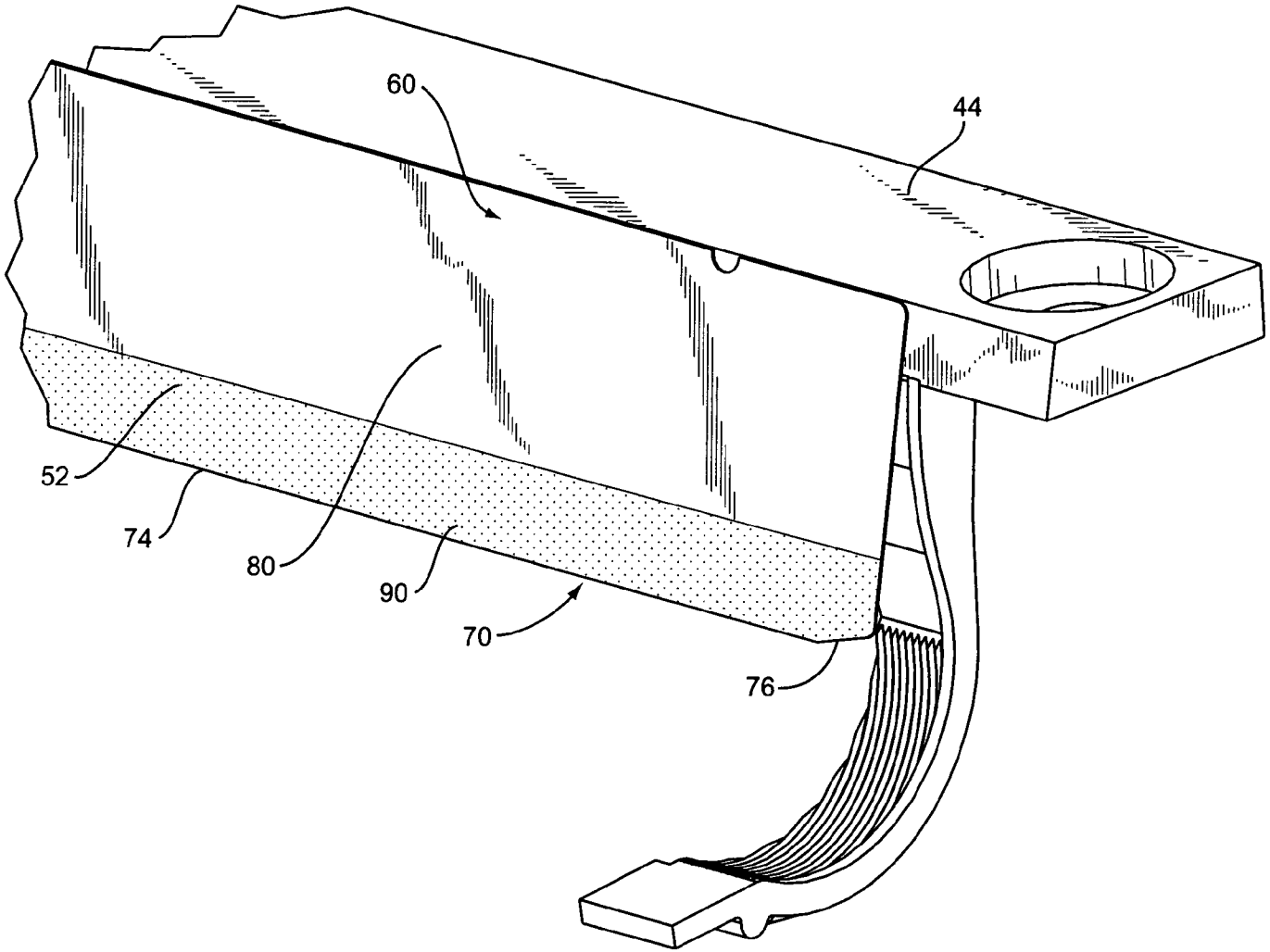
FIG. 4 shows another perspective view of the doctor blade of FIG. 2 with the developer roller removed and an end seal added.

The nip portion 70 of the doctor blade 29 is supported by the mounting portion 60 in a cantilever fashion. That is, the nip portion 70 is not affixed to another portion of the frame, but is instead supported from the frame by the mounting portion 60. The nip portion 70 includes a portion that forms the nip 42 with the developer roller 27 and an optional overhang portion 72 that extends beyond the nip 42. Due to the flexibility of the doctor blade 29, the nip portion 70 presses against the developer roller 27 due to its inherent spring force. This is represented in FIG. 3 where the un-deflected free state of the doctor blade 29 is shown in phantom lines, and the in-use deflected state of the doctor blade 29 is shown in solid lines. Further, as shown in the figures, the nip portion 70 typically presses against the developer roller 27 in such a fashion that the doctor blade 29 is generally tangent to the developer roller 27 at the nip 42. The doctor blade 29 may press against the developer roller 27 with any suitable amount of force per unit length, such as approximately 0.08–0.09 N/mm; note also that this pressing force need not be uniform across the lateral width of the developer roller, such as by using a curved bracket 44, or causing the doctor blade to have a lateral bow (see U.S. Pat. No. 5,485,254), or by any other means known in the art. Note further that because the developer roller 27 has a compressible surface, the pressing of the doctor blade 29 causes the nip 42 formed therebetween to be a small area rather than a simple point (when viewed from the side). The nip 42 may advantageously have a length along the doctor blade 29 of 0.6 mm to 1.2 mm. The distance from the center of this nip 42 to the end 74 of the blade 29, defining the overhang area 72, may be on the order of 0.25 mm to 2 mm, and advantageously approximately 1.3 mm. The distal tip 74 of the doctor blade 29 may have a simple straight profile, or may include a bend or bends, a forward facing chamfer, or any other shape known in the art. The lateral edges of the nip portion 70 may also be relatively straight, or may have any other shape known in the art. For example, the lateral leading edges of the doctor blade 29 may advantageously include chamfers 76, such as 15° by three millimeter chamfers 76 shown in FIG. 4.

As described above, the doctor blade 29 shown in the foregoing Figures is disposed in what is commonly referred to as a "counter" orientation in that the moveable tip 74 of the doctor blade 29 at or near the nip 42 is disposed upstream of the mounting portion 60 of the doctor blade 29, with respect to the direction of the rotation of the developer roller 27. For some embodiments of the present invention, the doctor blade 29 may instead be oriented in a following (or "trailing") orientation, where the nip portion 70 is disposed downstream from the mounting portion 60. Further, the mounting method employed to mount the doctor blade 29 may advantageously allow for a bias voltage to be applied to the doctor blade 29 to assist in controlling toner charge for the residual toner on the developer roller 27. The particular characteristics of the applied bias voltage, if any, are not important to understanding the present invention, and any approach known in the art may be employed.

Figure 5:
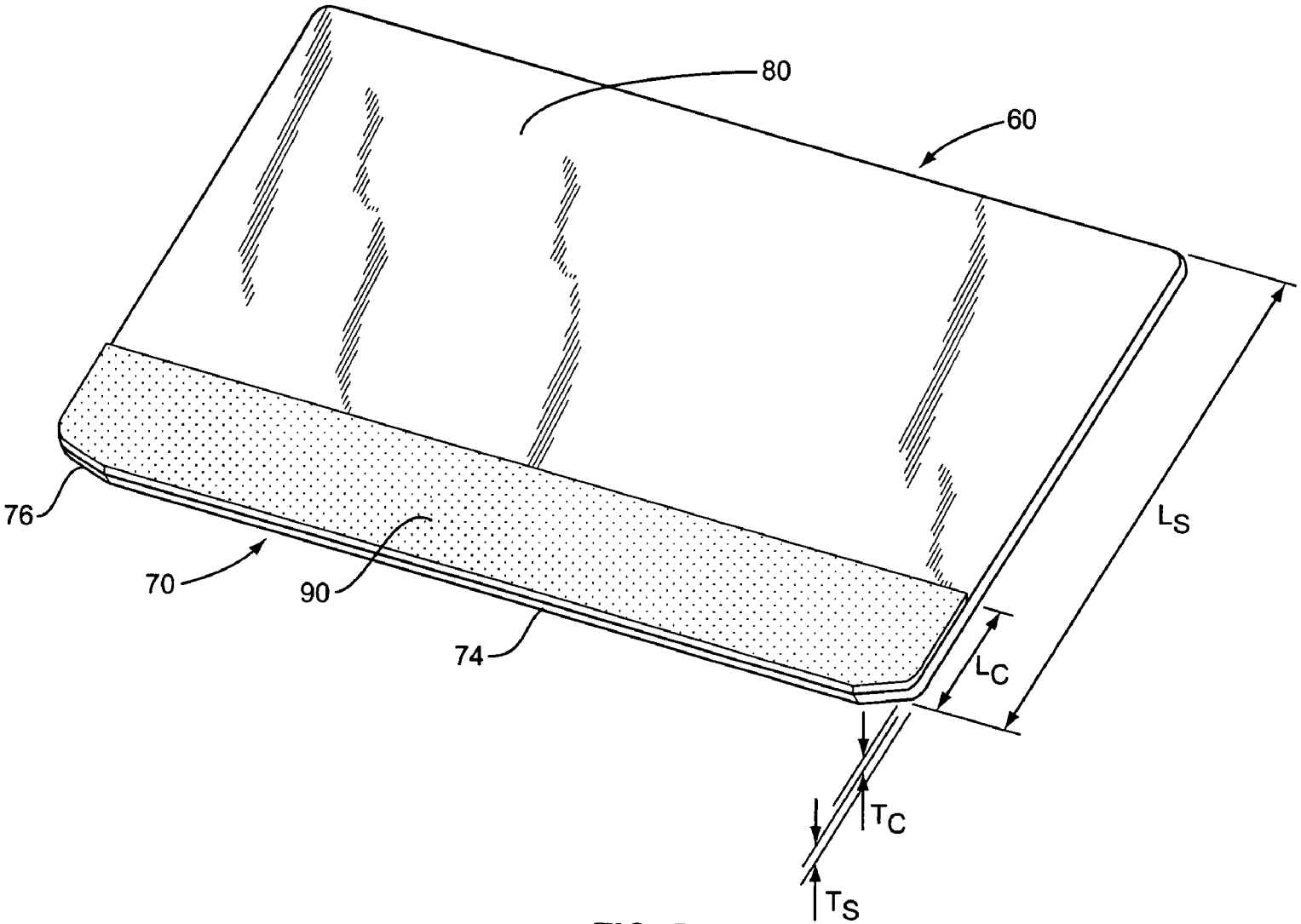
FIG. 5 shows a perspective view of the doctor blade of FIG. 2.

Referring to FIG. 5, the doctor blade 29 includes a substrate 80 and a coating 90. The substrate 80 forms the majority of the doctor blade 29 and typically takes the form of thin, generally rectangular, plate-like member made from a flexible material. For example, the substrate 80 may be formed from a phosphor-bronze "shim" material with a thickness Ts of a nominally 0.025 mm to 0.20 mm, advantageously approximately 0.076 mm, and a length Ls of nominally 12 mm. Such a substrate 80 material has a substantial inherent flexibility that allows it to be deflected a substantial amount and spring back with little to no permanent deformation. A metallic material is believed advantageous for the substrate 80, as such materials are typically highly conductive and resilient. The conductivity may be advantageous in some situations, so as to allow for the bias voltage differential between the doctor blade 29 and the developer roller 27 discussed above to be readily controlled, thereby allowing the charge level on the residual toner on the developer roller 27 after the nip 42 to be properly controlled. The preferred level of this induced charging (if any), which is typically combined with the triboelectric charging associated with the nip 42, will depend on the particular application, as is understood by those of skill in such art. In addition to electrical conductivity, metallic materials offer high thermal conductivity, which allows the substrate 80 to aid in pulling heat away from the area of the nip 42 so as to lessen the potential for melting the toner. For ease of reference, the surface of the substrate 80 facing the developer roller 27 will be referred to as the front side 52, with the opposite surface of the substrate 80—facing away from the developer roller 27—referred to as the back side 54. It should be noted that while the substrate 80 may be of a non-homogenous and/or multi-layer construction, the present discussion assumes a homogenous single-layer construction for simplicity.

The coating 90 of the doctor blade 29 is disposed on at least the front side 52 of the substrate 80 in the area of the nip 42. For instance, the coating 90 may be disposed over an area extending from a point near the tip 74 of the substrate 80 to a point on the other side of the nip 42 (towards the mounting portion 60). The length Lc of coating 90 may be, for example, approximately 4 mm. The thickness Tc of the coating 90 may be in the range of 3 um to 30 um, and more advantageously be in the range of 5 um to 15 um. The coating 90 is advantageously metallic. Further, the coating may advantageously substantially homogeneous and/or substantially uniform in composition. In addition, the coating 90 may advantageously have an "as applied" (without further processing) surface roughness in the range of ≦2.0 um Ra measured using a contact profilometer, advantageously in the range of 0.2 to 1.5 um Ra, and more advantageously in the range of 0.7 to 1.1 um Ra. It should be noted that the material of the coating 90 should have suitable abrasion properties so as be able have a sufficient operating life, such as twelve thousand pages or more, depending on the application.

As noted above, the coating 90 is of a metallic type. Suitable known metallic materials for the coating 90 include molybdenum, tungsten carbide, and alloys of those materials. More broadly stated, the coating, in some embodiments, is composed of one or more materials, where at least one material is selected from the group consisting of molybdenum and tungsten. Necessarily included under such a description are pure molybdenum, tungsten carbide, etc. and alloys or mixtures of any of the aforesaid materials. When applied using the plasma deposition type of thermal spray deposition process (discussed further below), it is believed that molybdenum and tungsten carbide (typically in a cobalt matrix) will provide good performance at a reasonable manufacturing cost.

As indicated below, the coating 90 may be applied to the substrate 80 using a thermal spray process, such as the plasma deposition process that is sometimes referred to as "air plasma spraying," High Velocity Oxy-Fuel Spray (HVOF), electric arc wire spray, or other thermal spray techniques known in the art. By way of non-limiting example, the plasma deposition process for a molybdenum coating 90 may use a type 9 MB plasma spray gun; a type 4 MP feeder with vibrating air; a type 7 M plasma spray control unit; all from Sulzer Metco of Westbury, N.Y.; a Jet Kote Surfacing Systems feeder control unit Deloro Stellite Co. of Goshen, Ind., and a GE 728 five port nozzle from A-Flame Corp. of Cincinnati, Ohio placed three and one-half to six inches (more advantageously four to five inches, such as four and one-half inches) from the substrate. The gas mixture may be argon/helium, with the argon primary gas supplied at 65–75 psi and 150 liters/minute and the helium secondary gas supplied at 65–75 psi and 65 liters/minute. A molybdenum powder of type 118FNS molybdenum from Powder Alloy Corp. of Cincinnati, Ohio may be used with a feed pressure of 92 psi. The cooling air may be at 55 psi. The plasma discharge may have an arc pressure of 60 volts and a current of 800 amps. Alternative powders include type AE8245 (Sulzer Metco), type AE8175 tungsten carbide-cobalt (Sulzer Metco), and blends thereof.

The doctor blade 29 described above may be used in a toner regulating system 40 to help regulate the amount of toner on the developer roller 27. In the illustrative toner regulating system 40, a doctor blade 29 as described above is mounted to a frame of the cartridge 20 along its mounting portion 60, and presses against the developer roller 27 at its nip portion 70 to form a nip 42. The formed nip 42 helps regulate the thickness of the residual toner left on the developer roller 27, and also advantageously applies a triboelectric and/or induced charge on the residual toner. Thus, as suitably thick and charged layer of toner may be formed on the developer roller 27 and carried to the developing location. Just by way of non-limiting example, the residual toner may have a thickness in the range of 4 um to 20 um, for a density of 0.3 to 1.2 mg/cm$^2$, and a charge of −12 uC/gm to −35 uC/gm.

Such a toner regulating system 40 may be used with toner that is mono-component or multi-component, magnetic or non-magnetic, color or black, or any other toner used in electrophotographic systems.

The discussion above has been in the context of a conventional multi-color laser printer 10 for illustrative purposes; however, it should be noted that the present invention is not so limited and may be used in any electrophotographic system, including laser printers, copiers, and the like. Further, the illustrative discussion above has been used a developer roller 27 and the relevant toner carrier, but the present is invention is not limited to use with developer rollers 27, and may be used to regulate the thickness and/or charge on developer belts or any other developer carrier.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner layer regulating system for an electrophotographic image forming apparatus, comprising:

a toner carrier;

a toner regulating member disposed proximate said toner carrier, having a first surface disposed toward said toner carrier, and forming a nip with said toner carrier; said toner regulating member comprising a flexible metallic substrate and a metallic coating applied to cover an area of said first surface forming said nip; and wherein said coating comprises at least a material selected from the group consisting of molybdenum and tungsten carbide.

2. The toner regulating system of claim 1 wherein said coating has a thickness of not more than 30 um.

3. The toner regulating system of claim 1 wherein said coating is a thermal sprayed coating of a thickness of not more than 30 um.

4. The toner regulating system of claim 1 wherein said toner regulating member has a first portion mounted to a support and a second portion supported in cantilever fashion by said first portion; said nip disposed in said second portion.

5. The toner regulating system of claim 4 wherein said coating is limited to said second portion of said toner regulating member.

6. The toner regulating system of claim 1 wherein said substrate comprises a first material and said coating comprises a second material different from said first material.

7. The toner regulating system of claim 1 wherein said substrate has a thickness in the range of 0.02 mm to 0.20 mm.

8. The toner regulating system of claim 1 wherein said coating has a surface roughness of ≦2.0 um Ra.

9. The toner regulating system of claim 8 wherein said coating has a surface roughness of 0.2 um to 1.5 um Ra.

10. The toner regulating system of claim 9 wherein said coating has a surface roughness of 0.7 um to 1.1 um Ra.

11. The toner regulating system of claim 1 wherein said coating is substantially homogeneous.

12. The toner regulating system of claim 1 wherein said substrate has a generally plate-like appearance and wherein said metallic coating directly contacts the metal of said metallic substrate.

13. The toner regulating system of claim 1 wherein said coating is a thermal sprayed coating of a thickness of not more than 30 um and an as-applied surface roughness of ≦2.0 um Ra.

14. The toner regulating system of claim 1:

wherein said coating is a thermal sprayed coating of a thickness of not more than 30 um;

wherein said substrate comprises a first material and said coating comprises a second material different from said first material;

wherein said coating has a surface roughness of ≦2.0 um Ra;

wherein said coating is substantially uniform in composition; and wherein said substrate has a generally plate-like appearance.

15. The toner regulating system of claim 1 wherein said metallic coating comprises molybdenum.

16. A toner layer regulating system for an electrophotographic image forming apparatus, comprising:

a toner carrier;

a toner regulating member disposed proximate said toner carrier and forming a nip with said toner carrier, said toner regulating member having a first portion mounted to a support and a second portion supported in cantilever fashion by said first portion, said nip disposed in said second portion, said toner regulating member further having a first surface disposed toward said toner carrier;

said toner regulating member comprising a flexible metallic substrate and a coating over an area of said first surface forming said nip;

wherein said coating comprises a thermal sprayed metallic coating of not more than 30 um thickness, said coating comprising at least a material selected from the group consisting of molybdenum and tungsten;

wherein substrate comprises a first material and said coating comprises a second material different from said first material and said coating is limited to said second portion of said toner regulating member; and wherein said coating has a surface roughness of ≦2.0 um Ra.

17. The toner regulating system of claim 16 wherein said toner carrier comprises a developer roller.

18. The toner regulating system of claim 16 wherein said doctor blade extends beyond said nip in a direction away from said first portion.

19. The toner regulating system of claim 16 wherein said doctor blade is mounted to said support at a location downstream from said nip with respect to a direction said toner carrier carries toner.

20. The toner regulating system of claim 16:

wherein said coating has an as applied surface roughness of 0.2 um to 1.5 um Ra;

wherein said doctor blade extends beyond said nip in a direction away from said first portion; and wherein said doctor blade is mounted to said support at a location downstream from said nip with respect to a direction said toner carrier carries toner.

21. A toner layer regulating system for an electrophotographic image forming apparatus, comprising:

a frame;

a doctor blade forming a nip with a toner carrier and comprising a flexible metallic substrate cantilevered from said frame, said doctor blade further comprising an external metallic coating disposed to cover at least a portion of a side of said flexible substrate proximate said nip;

wherein said coating comprises at least a material selected from the group consisting of molybdenum and tungsten; and wherein said nip is formed between said coating and said toner carrier.

22. The toner regulating system of claim 21 wherein said toner carrier comprises a developer roller.

23. The toner regulating system of claim 21 wherein said coating has a surface roughness of ≦2.0 um Ra.

24. The toner regulating system of claim 21 wherein said coating has a surface roughness of 0.2 um to 1.5 um Ra.

25. The toner regulating system of claim 21 wherein said doctor blade extends beyond said nip in a direction away from said frame.

26. A toner cartridge, comprising:

a housing;

a toner carrier rotatably supported by said housing;

a toner regulating member disposed proximate said toner carrier, having a first surface disposed toward said toner carrier, and forming a nip with said toner carrier; said toner regulating member comprising a flexible metallic substrate and a metallic coating disposed so as to cover said first surface in an area thereof forming said nip; and wherein said coating comprises at least a material selected from the group consisting of molybdenum and tungsten.

27. The toner cartridge of claim 26 wherein said coating has a thickness of not more than 30 um.

28. The toner cartridge of claim 26 wherein said coating is a thermal sprayed coating of a thickness of not more than 30 um.

29. The toner cartridge of claim 26 wherein said toner regulating member has a first portion mounted for support by said housing and a second portion supported in cantilever fashion by said first portion; said nip disposed in said second portion.

30. The toner cartridge of claim 26 wherein said substrate has a thickness in the range of 0.02 mm to 0.20 mm.

31. The toner cartridge of claim 26 wherein said coating has a surface roughness of ≦2.0 um Ra.

32. The toner cartridge of claim 31 wherein said coating has a surface roughness of 0.2 um to 1.5 um Ra.

33. The toner cartridge of claim 32 wherein said coating has a surface roughness of 0.7 um to 1.1 um Ra.

34. The toner cartridge of claim 26 wherein said coating is substantially homogeneous.

35. The toner cartridge of claim 26 wherein said substrate has a generally plate-like appearance.

36. The toner cartridge of claim 26 wherein:

said coating is a thermal sprayed coating of a thickness of not more than 30 um;

said toner regulating member has a first portion mounted for support by said housing and a second portion supported in cantilever fashion by said first portion; said nip disposed in said second portion;

said substrate has a thickness of approximately 0.075 mm; and said coating has a surface roughness of ≦2.0 um Ra.

37. An image forming device, comprising:

a latent image carrier;

a toner carrier rotatably supported by said housing and supplying toner to said latent image carrier;

a toner regulating member disposed proximate said toner carrier, having a first surface disposed toward said toner carrier, and forming a nip with said toner carrier; said toner regulating member comprising a flexible metallic substrate and a metallic coating disposed to cover an area of said first surface forming said nip; and wherein said coating comprises at least a material selected from the group consisting of molybdenum and tungsten.

38. The image forming device of claim 37 wherein said coating has a thickness of not more than 30 um.

39. The image forming device of claim 37 wherein said coating is a thermal sprayed coating of a thickness of not more than 30 um.

40. The image forming device of claim 37 wherein said toner regulating member has a first portion mounted for support by said housing and a second portion supported in cantilever fashion by said first portion; said nip disposed in said second portion.

41. The image forming device of claim 37 wherein said substrate has a thickness in the range of 0.02 mm to 0.20 mm.

42. The image forming device of claim 37 wherein said coating has a surface roughness of ≦2.0 um Ra.

43. The image forming device of claim 42 wherein said coating has a surface roughness of 0.2 um to 1.5 um Ra.

44. The image forming device of claim 43 wherein said coating has a surface roughness of 0.7 um to 1.1 um Ra.

45. The image forming device of claim 37 wherein said coating is substantially uniform in composition.

46. The image forming device of claim 37 wherein said substrate has a generally plate-like appearance, and wherein said toner carrier comprises a developer roller.

47. The image forming device of claim 37 wherein:

said toner carrier comprises a developer roller;

said coating is a substantially homogeneous thermal sprayed coating of a thickness of not more than 30 um;

said toner regulating member has a first portion mounted for support by said housing and a second portion supported in cantilever fashion by said first portion; said nip disposed in said second portion;

said substrate has a thickness in the range of 0.02 mm to 0.20 mm; and said coating has a surface roughness of 0.2 to 1.5 um Ra.

48. A toner layer regulating system for an electrophotographic image forming apparatus, comprising:

a toner carrier;

a toner regulating member disposed proximate said toner carrier, having a first surface disposed toward said toner carrier, and forming a nip with said toner carrier; said toner regulating member comprising a flexible metallic substrate and a metallic coating applied on said first surface in an area thereof forming said nip;

wherein said metallic coating comprises molybdenum.

49. The toner regulating system of claim 48 wherein said molybdenum is the largest constituent component of said coating on a by weight basis.

* * * * *